United States Patent [19]

Teduschi

[11] Patent Number: 4,991,325

[45] Date of Patent: Feb. 12, 1991

[54] COLLAPSIBLE IRONING BOARD HAVING TELESCOPIC IRONING SURFACES, AND TELESCOPIC LEGS ATTACHED BY U-SHAPED BRACKETS AND V-SHAPED ARMED CONNECTORS

[76] Inventor: Carmine F. Teduschi, 616 Tower Mews, Oakdale, N.Y. 11769

[21] Appl. No.: 466,989

[22] Filed: Jan. 18, 1990

[51] Int. Cl.[5] ..... D06F 81/00; D06F 81/02; D06F 81/04; D06F 81/10

[52] U.S. Cl. ..... 38/138; 38/103; 38/79; 38/96; 38/107; 248/121; 248/188; 108/116; 108/144; 108/127; 108/439

[58] Field of Search ..... 38/DIG. 1, DIG. 2, DIG. 3, 38/1 A, 1 R, 66, 102.8, 103, 104, 112, 135, 138, 139; 108/116, 127, 122, 123, 124, 125; 248/121, 150, 152, 155.2, 155.4, 200, 206.1, 439, 462, 463, 464, 674, 677; 403/79, 157, 158, 159

[56] References Cited

U.S. PATENT DOCUMENTS

| | | | |
|---|---|---|---|
| 2,221,932 | 11/1940 | Utley | 248/439 |
| 2,637,919 | 5/1953 | Buchanan | 38/138 |
| 2,718,077 | 9/1955 | Grissette | 38/138 |
| 2,921,763 | 1/1960 | Miller et al. | 248/121 |
| 3,055,129 | 9/1962 | Selleck | 38/142 X |
| 3,064,373 | 11/1962 | Spain | 38/138 X |
| 3,310,268 | 3/1967 | Kramer | 248/439 X |
| 3,609,892 | 10/1971 | Caire | 38/138 |
| 3,965,588 | 6/1976 | Long | 108/116 X |
| 4,630,816 | 12/1986 | Hill | 108/127 X |

*Primary Examiner*—Werner H. Schroeder
*Assistant Examiner*—Ismael Izaguirre
*Attorney, Agent, or Firm*—Michael I. Kroll

[57] ABSTRACT

A collapsible ironing board is provided and consists of a platform having two extendable telescopic sections and three collapsible legs. When the ironing board is not being used, the two sections of the platform can be pushed together and the legs folded up into a closed position allowing the ironing board in its reduced size to be stored away.

4 Claims, 2 Drawing Sheets

Fig. 1
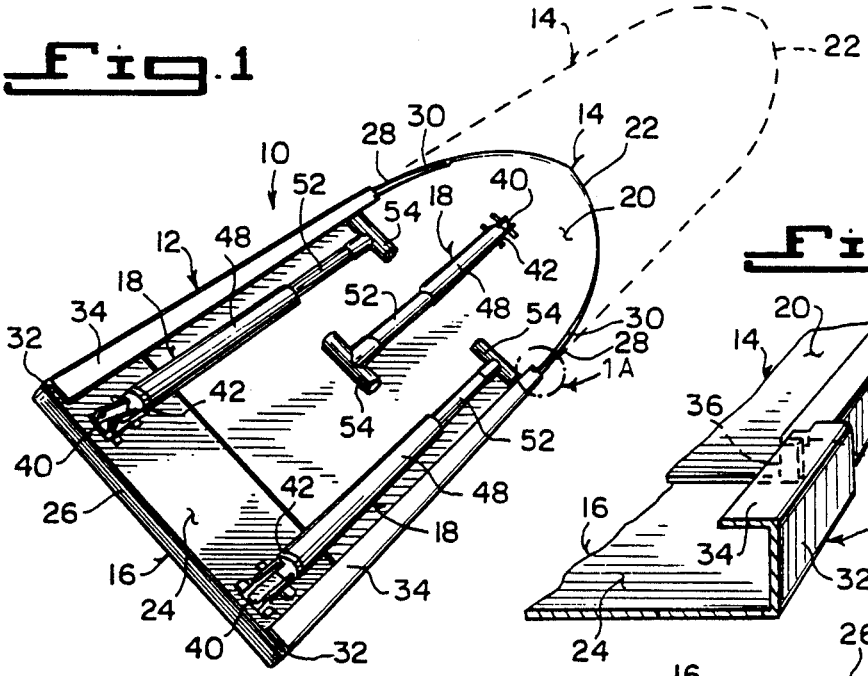
Fig. 1A
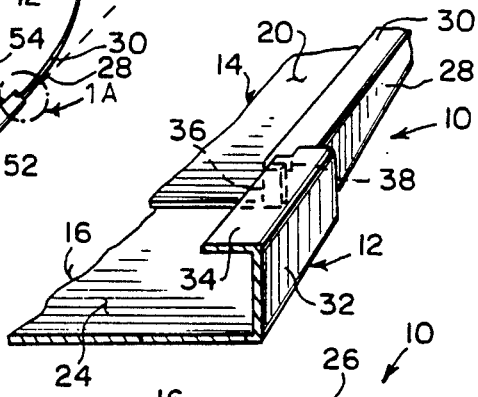
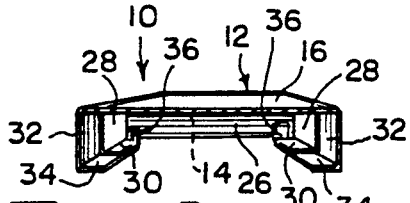
Fig. 3
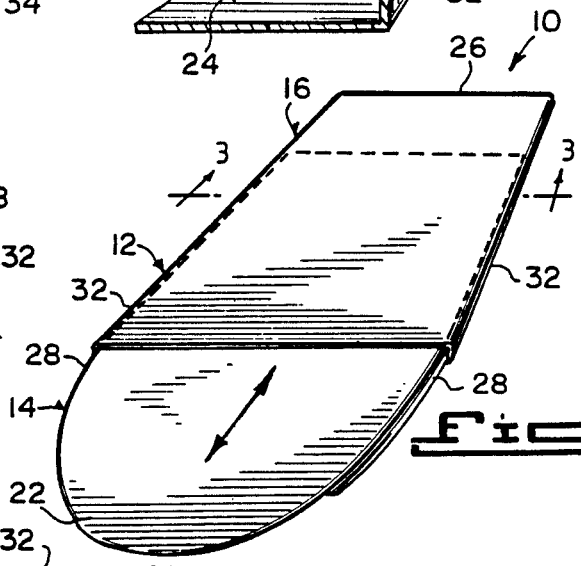
Fig. 2
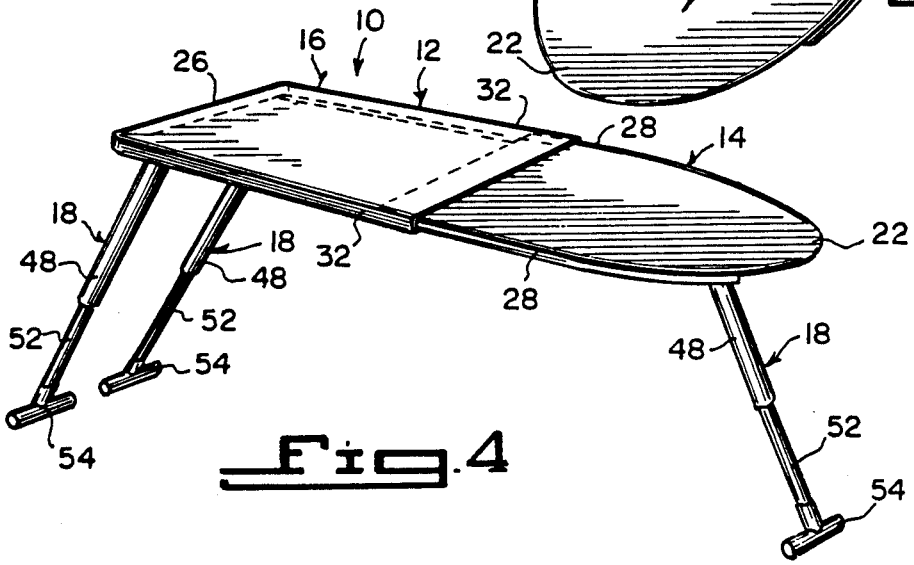
Fig. 4

COLLAPSIBLE IRONING BOARD HAVING TELESCOPIC IRONING SURFACES, AND TELESCOPIC LEGS ATTACHED BY U-SHAPED BRACKETS AND V-SHAPED ARMED CONNECTORS

BACKGROUND OF THE INVENTION

1. Field of the Invention

The instant invention relates generally to ironing boards and more specifically it relates to a collapsible ironing board.

2. Description of the Prior Art

Numerous ironing boards have been provided in prior art that are adapted to include legs which can be folded up so that the ironing boards can be placed into stored positions. While these units may be suitable for the particular purpose to which they address, they would not be as suitable for the purposes of the present invention as heretofore described.

SUMMARY OF THE INVENTION

A primary object of the present invention is to provide a collapsible ironing board that will overcome the shortcomings of the prior art devices.

Another object is to provide a collapsible ironing board in which the platform is telescopic so that when the ironing board is to be stored, the telescopic platform can be placed into a closed reduced length position and legs folded up to decrease its size.

An additional object is to provide a collapsible ironing board in which a compartment can be included on the underside of the platform to hold various small items such as adapter plugs, while an area can also be included on the underside of the platform to hold a steam iron when not in use.

A further object is to provide a collapsible ironing board that is simple and easy to use.

A still further object is to provide a collapsible ironing board that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING PICTURE

FIG. 1 is a bottom perspective view of the invention in a folded collapsed position.

FIG. 1A is an enlarged view as indicated by arrow 1A in FIG. 1, showing the stop flanges in greater detail.

FIG. 2 is a top perspective view of the invention in the folded collapsed position.

FIG. 3 is a cross sectional perspective view taken along line 3—3 in FIG. 2.

FIG. 4 is a perspective view of the invention in an open position ready to be used.

DETAILED DESCRIPTION OF THE PREFERRED EMBODIMENTS

Figure 5:
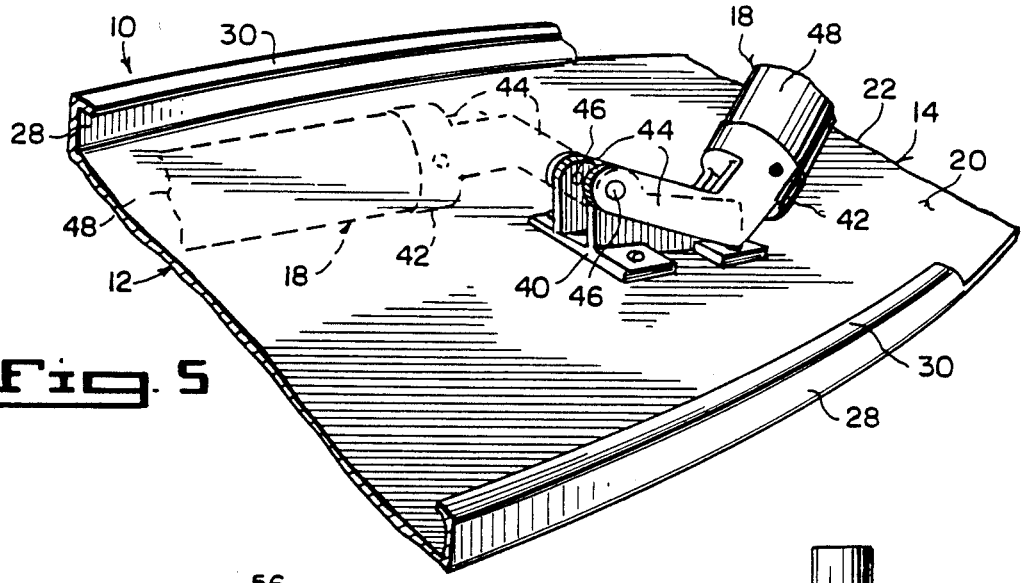
FIG. 5 is a bottom perspective view of the front member of the platform with parts broken away showing the front leg cooperating with the bracket attached thereto.

Turning now descriptively to the drawings, in which similar reference characters denote similar elements throughout the several views, FIGS. 1 through 5 illustrates a collapsible ironing board 10 consisting of a platform 12 being two extendable telescopic sections 14 and 16 in which the front section 14 slides within the back section 16. These collapsible legs 18 are provided. One leg 18 is pivotly attached to the bottom surface 20 of the front section 14 of the platform 12 near the front end 22. The other two legs 18 are in a spaced apart relationship and pivotly attached to the bottom surface 24 of the back section 16 of the platform 12 near the back end 26 thereof. When the ironing board 10 is not being used the two sections 14 and 16 of the platform 12 can be pushed together and the legs 18 folded into a closed up position allowing the ironing board 10 in its reduced size to be stored away.

The section 14 of the platform 12 contains a pair of side flanges 28, each having an inwardly facing lip 30, while the section 16 of the platform 12 contains a pair of side flanges 32, each having in inwardly facing lip 34. A stop member 36 is formed at a back end of each lip 30 on each flange 28 on the front section 14 while a stop member 38 is formed at a front end of each lip 34 on each flange 32 on the back section 16. When the sections 14 and 16 are extended the first stop members 36 will contact the second stop members 38 preventing the section 14 and 16 from disengaging from each other.

To pivotly attach each leg 18 to the platform 12, a U-shaped channel bracket 40 is provided. A connector 42 is affixed to a top of each leg 18 and has a pair of V-shaped arms 44 pivotly connected by pins 46 to one of the U-shaped channel brackets 40. When each leg 18 is placed in a down open position the V-shaped arms 44 will bear against the U-shaped channel bracket 40 (see FIG. 5) for support.

Figure 6:
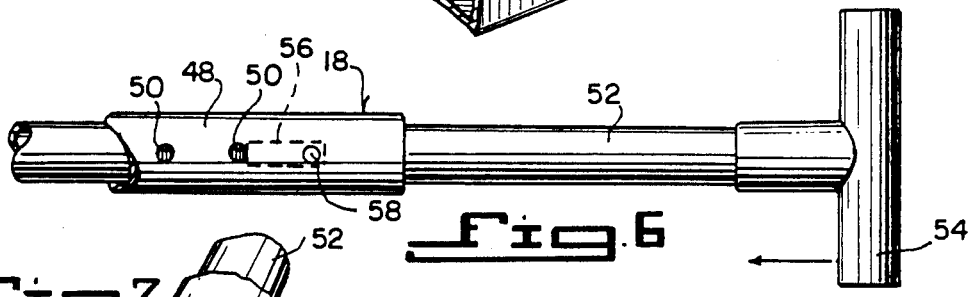
FIG. 6 is a top view of one of the legs with parts broken away.
Figure 7:
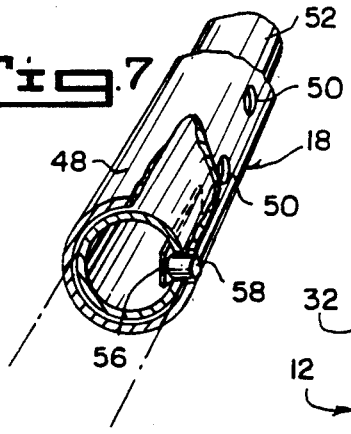
FIG. 7 is a perspective view of a portion of one of the legs showing the adjustable locking feature thereof.

As best shown in FIGS. 6 and 7, each leg 8 is adjustably telescopic to change the height of the platform 12 and includes an outer hollow shaft 48 affixed at one end to one connector 42. The outer hollow shaft 48 has a plurality of spaced apart holes 50 therealong. An inner hollow shaft 52 having a transverse foot 54 is attached at one end thereof with its other end slidable within the outer hollow shaft 48. A leaf spring 56 is affixed to an inner surface of the inner hollow shaft 52. Top member 58 is affixed to a free end of the leaf spring 56 and extends through the inner hollow shaft 52 to engage with one of the holes 50 in the outer hollow shaft 48 to releasably lock the inner hollow shaft 52 in any position with respect to the outer hollow shaft 48, until the tab member 58 is pushed in, thus allowing the inner hollow shaft 52 to slide to another position.

Figure 8:
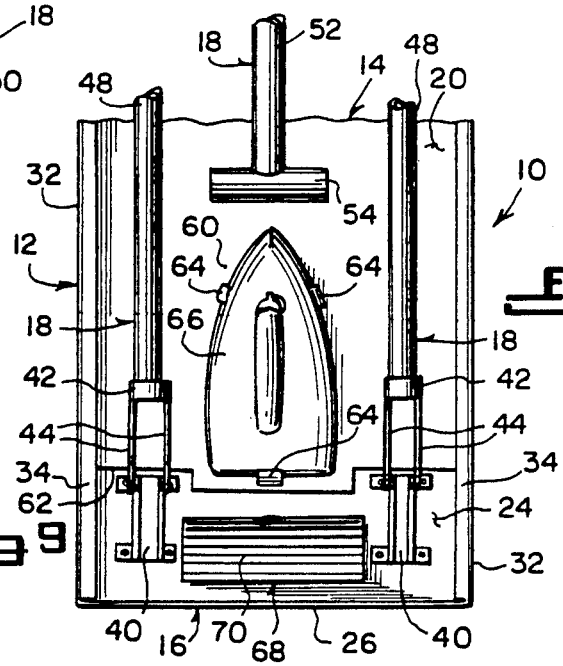
FIG. 8 is a bottom view of a modification with parts broken away showing a compartment and steam iron holder.
Figure 9:
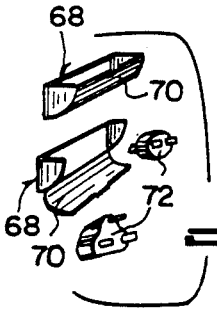
FIG. 9 is a perspective view showing the compartment in greater detail and the plugs which can be held therein.

FIG. 8 shows an area 60 on the bottom surface 20 of the front section 14 of the platform 12 near the back end 62 thereof, having three clips 64 for holding a stem iron 66 thereto when the steam iron 66 is not being used. A compartment 68, shown in FIGS. 8 and 9, can be affixed on the bottom surface 24 of the second section 16 of the platform 12 near the back end 26 thereof. The compartment 68 has a hinged door 70 for holding various small items 72 such as adapter plugs or the like.

Since the ironing board 10 is collapsible and portable, it will take up less storage area and fit into small spaces. The ironing board 10 also is good for people who live in apartments and who own boats.

LIST OF REFERENCE NUMBERS 10 collapsible ironing board
12 platform
14 front section of 12
16 back section of 12
18 collapsible leg
20 bottom surface of 14
22 front end of 14
24 bottom surface of 16
26 back end of 16
28 side flange on 14
30 inwardly facing lip on 28
32 side flange on 16
34 inwardly facing lip on 32
36 first stop member on 30
38 second stop member on 34
40 U-shaped channel bracket
42 connector
44 V-shaped arm
46 pivot pin
48 outer hollow shaft of 18
50 hole in 48
52 inner hollow shaft of 18
54 transverse foot
56 leaf spring
58 tab member
60 area on 20
62 back end of 14
64 clip
66 steam iron It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapted it for various applications without omitting features that, from the standpoint of prior art, fairly constitute essential characteristics of the generic or specific aspects of this invention.

What is claimed is new and desired to be protected by Letters Patent is set forth in the appended claims:

1. A collapsible ironing board comprising:

(a) a platform comprising two extendable telescopic sections, wherein a front section sliding within a back section, each of the sections of said platform includes a pair of side flanges each having an inwardly facing lip, a pair of first stop members, each formed at a back end of each of the lips of said flanges on the front section, and a pair of second stop members, each formed at a front end of each of the lips of said flanges on the back section so that when the sections are extended said first stop members will connect said second stop members preventing the sections from disengaging from each other;

(b) three collapsible legs; and (c) means for pivotally attaching one of said legs to a bottom surface of the front section of said platform near the front end thereof and for pivotally attaching said other two legs in a spaced apart relationship to a bottom surface of the back section of said platform near the back end thereof so that when said ironing board is not being used, the two sections of said platform are pushed together and said legs folded into a closed position allowing said ironing board in its reduced size to be stored away, said pivotally attaching means for each key includes a U-shaped channel bracket, and a connectors affixed to a top of each of said legs and having a pair of V-shaped arms pivotally connected to one of said U-shaped channel brackets so that when each leg is placed in an open position the V-shaped arms will bear against said U-shaped channel bracket for support.

2. A collapsible ironing board as recited in claim 1, wherein each leg is adjustably telescopic to change the height of said platform and includes:

(a) an outer hollow shaft affixed at one end to one said connector, said outer hollow shaft having a plurality of spaced apart holes therealong;

(b) an inner hollow shaft having a transverse foot attached at one end thereof with the other end slidable within said outer hollow shaft;

(c) a leaf spring affixed to an inner surface of said inner hollow shaft; and (d) a tab member affixed to a free end of said leaf spring and extends through said inner hollow shaft to engage with one of the holes in said outer hollow shaft to releasably lock said inner hollow shaft in any position with respect to said outer hollow shaft, until said tab member is pushed in, thus allowing said inner hollow shaft to slide to another position.

3. A collapsible ironing board as recited in claim 1, further, including an area on a bottom surface of the front section of said platform near a back end thereof, having three clips for holding a stream iron thereto when the steam iron is not being used.

4. A collapsible ironing board as recited in claim 3, further including a compartment affixed on the bottom surface of the second section of said platform near the back end thereof having a hinged door for holding various small items therein for storage.

* * * * *

UNITED STATES PATENT AND TRADEMARK OFFICE

CERTIFICATE OF CORRECTION

PATENT NO. : 4,991,325

DATED : February 12, 1991

INVENTOR(S) : Carmine F. Tedeschi

It is certified that error appears in the above-indentified patent and that said Letters Patent is hereby corrected as shown below:

Title page, item [76], inventor: should read--Carmine F. Tedeschi--.

Signed and Sealed this

First Day of November, 1994

*Attest:*

*Attesting Officer*

BRUCE LEHMAN

*Commissioner of Patents and Trademarks*